US008555691B2

(12) United States Patent
Kurisu et al.

(10) Patent No.: US 8,555,691 B2
(45) Date of Patent: Oct. 15, 2013

(54) METAL PLATE MATERIAL HOT PRESS MOLDING APPARATUS AND HOT PRESS MOLDING METHOD

(75) Inventors: Yasushi Kurisu, Chiba (JP); Yoshiaki Shia, Chiba (JP); Kazuto Yamamura, Chiba (JP); Yuuichi Ishimori, Chiba (JP); Hiroyuki Mitake, Chiba (JP); Tetsuo Shima, Chiba (JP); Hiroshi Fukuchi, Chiba (JP); Norimasa Yamasaki, Chiba (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 150 days.

(21) Appl. No.: 13/114,684

(22) Filed: May 24, 2011

(65) Prior Publication Data

US 2011/0219849 A1 Sep. 15, 2011

Related U.S. Application Data

(62) Division of application No. 10/574,742, filed as application No. PCT/JP2004/014174 on Sep. 28, 2004, now Pat. No. 8,069,697.

(30) Foreign Application Priority Data

Oct. 2, 2003 (JP) ..... 2003-344309

(51) Int. Cl.
*B21D 37/16* (2006.01)

(52) U.S. Cl.
USPC ..... 72/342.3; 72/342.6

(58) Field of Classification Search
USPC ..... 72/41, 43, 342.1–342.3, 342.6, 342.7, 72/342.94, 465.1, 469
See application file for complete search history.

(56) References Cited

U.S. PATENT DOCUMENTS

| | | | |
|---|---|---|---|
| 2,821,156 | A | 1/1958 | George |
| 3,705,509 | A | 12/1972 | Haller |
| 4,472,955 | A | 9/1984 | Nakamura et al. |
| 4,945,381 | A | 7/1990 | Yamagata et al. |
| 6,367,304 | B1 | 4/2002 | Fahrenbach |
| 6,539,765 | B2 | 4/2003 | Gates |
| 6,619,094 | B2 | 9/2003 | Juhl |

FOREIGN PATENT DOCUMENTS

| | | | |
|---|---|---|---|
| CN | 1031338 | | 3/1989 |
| JP | 44-158 | * | 1/1944 |
| JP | 44-158 | | 1/1969 |
| JP | 465059 | | 11/1971 |

(Continued)

OTHER PUBLICATIONS

European Office Action for Eupropean Application No. 04788241.0 mailed Jun. 1, 2012.

(Continued)

*Primary Examiner* — Debra Sullivan
(74) *Attorney, Agent, or Firm* — Dorsey & Whitney LLP

(57) ABSTRACT

A metal plate material hot molding apparatus is provided for press molding a heated metal plate material. The apparatus may include supply piping for a cooling medium in a mold, and ejection holes penetrating from a molding surface of the mold to the supply piping. The exemplary apparatus may also include discharge piping for the cooling medium situated in the mold, and discharge holes penetrating from the molding surface of the mold to the discharge piping, and cooling piping. Molding procedure can be performed while the cooling medium is ejected from the ejection holes to a gap between the metal plate material and the mold.

4 Claims, 6 Drawing Sheets

(56) References Cited

FOREIGN PATENT DOCUMENTS

| | | | |
|---|---|---|---|
| JP | 57-022827 | | 2/1982 |
| JP | 58181431 | | 10/1983 |
| JP | 61-72330 | | 5/1986 |
| JP | 63-072435 | | 4/1988 |
| JP | 01057939 | A * | 3/1989 |
| JP | 184826 | | 6/1989 |
| JP | 03118907 | | 5/1991 |
| JP | 06-071357 | | 3/1994 |
| JP | 06-114468 | | 4/1994 |
| JP | 06-182457 | | 7/1994 |
| JP | 06-210370 | | 8/1994 |
| JP | 07-047431 | | 2/1995 |
| JP | 07-144235 | | 6/1995 |
| JP | 10-029267 | | 2/1998 |
| JP | 10-180366 | | 7/1998 |
| JP | 2002-096121 | | 4/2002 |
| JP | 2002-239641 | | 8/2002 |
| JP | 2002-282951 | | 10/2002 |
| JP | 2003-010928 | | 1/2003 |
| SU | 716 698 | | 2/1980 |
| SU | 935166 | | 6/1982 |

OTHER PUBLICATIONS

Supplemental European Search Report for European Patent Application No. 04788241.0 dated Dec. 27, 2011.
U.S. Office Action dated Mar. 16, 2012 for U.S. Appl. No. 13/114,586.
U.S. Office Action dated Mar. 16, 2012 for U.S. Appl. No. 13/114,638.
The Supplementary European Search Report for Eupropean Application No. 12188195.7 dated Jan. 3, 2013.
English Summary of Japanese Office Action for Japanese Patent Application No. 2003-344309 mailed on Feb. 9, 2006.
Office Action for related Canadian Patent Application No. 2,540,737, mailed Jul. 31, 2008.
Office Action for related Chinese Patent Application No. 200480028678.5, mailed Jun. 8, 2007.
PCT International Preliminary Report on Patentability dated Jun. 22, 2006 for PCT International Application No. PCT/JP2004/014174.
Machine Translation of JP Patent 2002-282951, Oct . 2, 2002.
Machine Translation of JP Patent 06-210370, Aug. 2, 1994.
European Office Action for Eupropean Application No. 04 788 241.0 dated Jul. 25, 2013.

* cited by examiner

METAL PLATE MATERIAL HOT PRESS MOLDING APPARATUS AND HOT PRESS MOLDING METHOD

CROSS-REFERENCE TO RELATED APPLICATIONS

This application is a divisional of U.S. patent application Ser. No. 10/574,742 which was filed on Oct. 10, 2006, now U.S. Pat. No. 8,069,697, which application claims the benefit of PCT Application No. PCT/JP2004/014174 which was filed on Sep. 28, 2004 and published Apr. 14, 2005 as International Publication No. WO 2005/032740 (the "International Application"), the entire disclosure of which is incorporated herein by reference. This application claims priority from the International Application pursuant to 35 U.S.C. §365. The present application also claims priority under 35 U.S.C. §119 from Japanese Patent Application No. 2003-344309, filed Oct. 2, 2003, the disclosures of which are incorporated herein by reference in their entireties.

FIELD OF THE INVENTION

The present invention relates to a metal plate material hot press molding apparatus and hot press molding method for heating a metal plate material, and rapidly and uniformly cooling the molded material during and/or after hot press molding.

BACKGROUND INFORMATION

Press molding of a metal plate material is conventional working method used in manufacturing of automobiles, machines, electric equipment, transport equipment, etc. due to its high productivity and high-precision working ability. Recently, an increase in the strength of steel plate, for example, as a material for automobile parts has been advanced in terms of reduction in the weight of parts. In press molding of a high-tensile steel plate, a problem that spring-back, wrinkling, etc. may occur, which can cause defective shapes would likely manifest. Furthermore, an increase in the strength of the metal plate material causes increase in the pressure of a contact surface with a mold at the time of press molding, which can raise a problem that a frictional force between the mold and the metal plate material may exceed the withstand load of a lubricant oil to thereby cause a defective surface due to die galling or the like and damage the mold. In this manner, the productivity may consequently be reduces.

In order to prevent the occurrence of molding defects such as crack, wrinkling, and galling of the metal plate material after press molding, a method may be used for forming plural recesses in part or all of the surface of the mold and confining the lubricant oil between the surface of the mold and the metal plate material to thereby improve a sliding property, as described in Japanese Patent Application Laid-open No. Hei 6-210370. However, this method may have a problem in that if the friction force increases because of the increase in the strength of the metal plate material, a sufficient lubricating effect may not be obtained.

Moreover, when a metal plate material with low press moldability is molded, a hot press molding method of heating the metal plate material and pressing it at a high temperature can be effective. In this hot press molding, the cooling of the metal plate material after molding in terms of productivity may be of importance. Accordingly, a method for cooling with a refrigerant after press molding at a high temperature can be used, as described in Japanese Patent Application Laid-open No. Hei 7-47431 and Japanese Patent Application Laid-open No. 2002-282951.

However, the method described in Japanese Patent Application Laid-open No. Hei 7-47431 is used to supply air from an air output provided at a peripheral portion of a punch of a warm press mold, and perform cooling with the air with low heat capacity and heat conductivity as a medium> Such method may have difficulty in changing the air with air existing in a gap between the mold and the metal plate material, and thus can possess a problem of a low cooling efficiency. Furthermore, the method described in Japanese Patent Application Laid-open No. 2002-282951 is generally used to define a clearance between the mold and the metal plate material, provide refrigerant introducing grooves in a molding surface of the mold which touches the metal plate material; and increase the cooling rate using the refrigerant. However, when the refrigerant flows into the refrigerant introducing grooves, the temperature at the outlet side can become higher than that at the inlet side, and the refrigerant becomes difficult to flow along the grooves due to deformation of the metal plate material at the time of molding, which makes uniform cooling difficult. Additionally, there may be a problem that a continuous groove shape tends to be transferred to the molded metal plate material.

Accordingly, there is a need to overcome at least some of the above-described deficiencies.

SUMMARY OF EXEMPLARY EMBODIMENTS OF THE INVENTION

One of the objects of the present invention is to provide a metal plate material hot press molding apparatus and hot press molding method which makes it possible (e.g., in a hot press molding apparatus for heating and molding a metal plate material) to accelerate cooling of a mold and a molded piece to obtain a pressed product excellent in strength and dimensional accuracy in a relatively short period of time. Another object of the present invention is to further suppress a heat storage into the mold to improve productivity of the pressed product.

One of the exemplary embodiments of the present invention is provided based on, e.g., elucidating the sliding property and heat transfer phenomenon between the metal plate material and the mold in hot press molding and examining the cooling behavior of the metal plate material by a cooling medium in detail.

Accordingly, an exemplary embodiment of the present invention relates to a metal plate material hot molding apparatus for press molding a heated metal plate material. This apparatus may include supply piping for a cooling medium can be provided in a mold. Ejection holes for the cooling medium may be provided in a molding surface of the mold. Further, the supply piping and the ejection holes can communicate with one another.

According to another exemplary embodiment of the present invention, the ejection holes may have a diameter between about 100 μm and 10 mm, and a pitch between about 100 μm and 1000 mm. Further, discharge piping for the cooling medium can be provided in the mold. Discharge holes for the cooling medium may also be provided in the molding surface of the mold, with the discharge piping and the discharge holes capable of communicating with one another. The discharge holes may have a diameter between about 100 μm and 10 mm, and a pitch between about 100 μm and 1000 mm.

For example, according to yet another exemplary embodiment of the present invention, at least part of the mold can be formed from porous metal having plural holes. Cooling piping may be provided in the mold. A valve mechanism may be provided in the ejection hole. A sealing mechanism which prevents the cooling medium from flowing out can be provided at a periphery of the mold. Projections having an area ratio between about 1% and 90%, a diameter or circumcircle diameter between about 10 μm and 5 mm, and a height between about 5 μm and 1 mm may be provided on at least part of the molding surface of the mold. The projection is a NiW-plated layer or chrome-plated layer with a thickness between 10 μm and 80 μm.

According to still another exemplary embodiment of the present invention, the ejection hole for the cooling medium can be provided solely in a portion in the molding surface where a heat transfer coefficient between the metal plate material and the mold is about 2000 $W/m^2K$ or less.

In a still another exemplary embodiment of the present invention, a metal plate material hot molding method is provided for press molding a heated metal plate material using the metal plate material hot molding apparatus as described in any of the exemplary embodiments above. In this exemplary embodiment of the method of the present invention, molding can be performed while a cooling medium is ejected to a gap between the metal plate material and a mold from ejection holes. For example, the cooling medium may be ejected to the gap between the metal plate material and the mold can be discharged from the ejection holes and/or discharge holes. The cooling medium can be ejected solely to a portion where a heat transfer coefficient calculated by measuring temperatures of the metal plate material and the mold is about 2000 $W/m^2K$ or less.

According to another exemplary embodiment of the method according to the present invention, the cooling medium is can include water, a polyhydric alcohol, a polyhydric alcohol solution, polyglycol, a mineral oil with a flash point of about 120° C. or higher, synthetic ester, a silicon oil, a fluorine oil, grease with a dropping point of about 120° C. or higher, and/or a water emulsion obtained by mixing a surfactant into a mineral oil or synthetic ester. Further, the cooling medium can be ejected during holding at a press bottom dead center.

These and other objects, features and advantages of the present invention will become apparent upon reading the following detailed description of embodiments of the invention, when taken in conjunction with the appended claims.

BRIEF DESCRIPTION OF THE DRAWINGS

Further objects, features and advantages of the invention will become apparent from the following detailed description taken in conjunction with the accompanying figures showing illustrative embodiment(s), result(s) and/or feature(s) of the exemplary embodiment(s) of the present invention, in which.

DETAILED DESCRIPTION OF EXEMPLARY EMBODIMENTS OF INVENTION

According to an exemplary embodiment of the present invention, a metal plate material hot press molding method can be provided for (i) heating a metal plate material to a predetermined temperature (for example, between about 700° C. and 1000° C.) by an electric heating furnace or a heating device by induction heating, electric current heating, or the like, (ii) setting the high-temperature metal plate material in a mold of a press molding apparatus, (iii) pressing the metal plate material by molding surfaces of the mold, that is, contact surfaces of opposed punch and die, and (iv) holding the mold at a bottom dead center, a cooling medium is ejected from the mold during and/or after molding to forcibly cool a molded piece and the mold.

Examples of exemplary molds according to various embodiments of the present invention shown in FIG. 1A to FIG. 3B shall be described in further detail below.

Figure 1A:
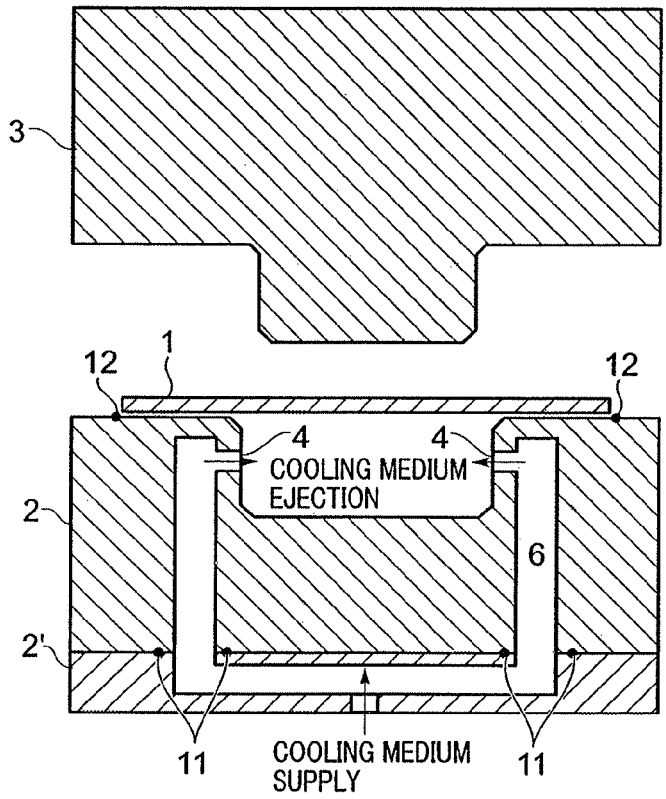
FIG. 1A is a sectional view of an exemplary mold according to an exemplary embodiment of the present invention provided with ejection holes and supply piping for a cooling medium.
Figure 1B:
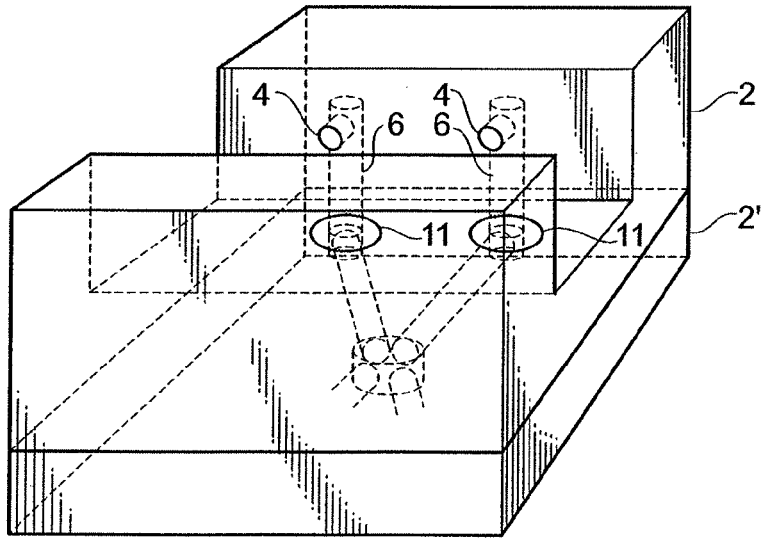
FIG. 1B is a perspective view of the exemplary mold of FIG. 1A.

FIGS. 1A and 1B schematically show an exemplary mold according to one exemplary embodiment of the present invention in which ejection holes 4 and supply piping 6 for the cooling medium are provided in a die 2 being a lower mold, and the supply piping 6 for the cooling medium provided in the die 2 and a die holder 2' are connected by bolts via O-rings 11. As shown in FIG. 1A, a rubber O-ring is provided as a sealing mechanism 12 which prevents the cooling medium from flowing out is provided at a periphery of the die 2. FIGS. 1A and 1B show side and perspective view of an example in which the ejection holes 4 for the cooling medium are provided in a vertical wall portion of the die, and also may be provided in a bottom portion, as well as in both the vertical wall portion and the bottom portion.

Figure 2A:
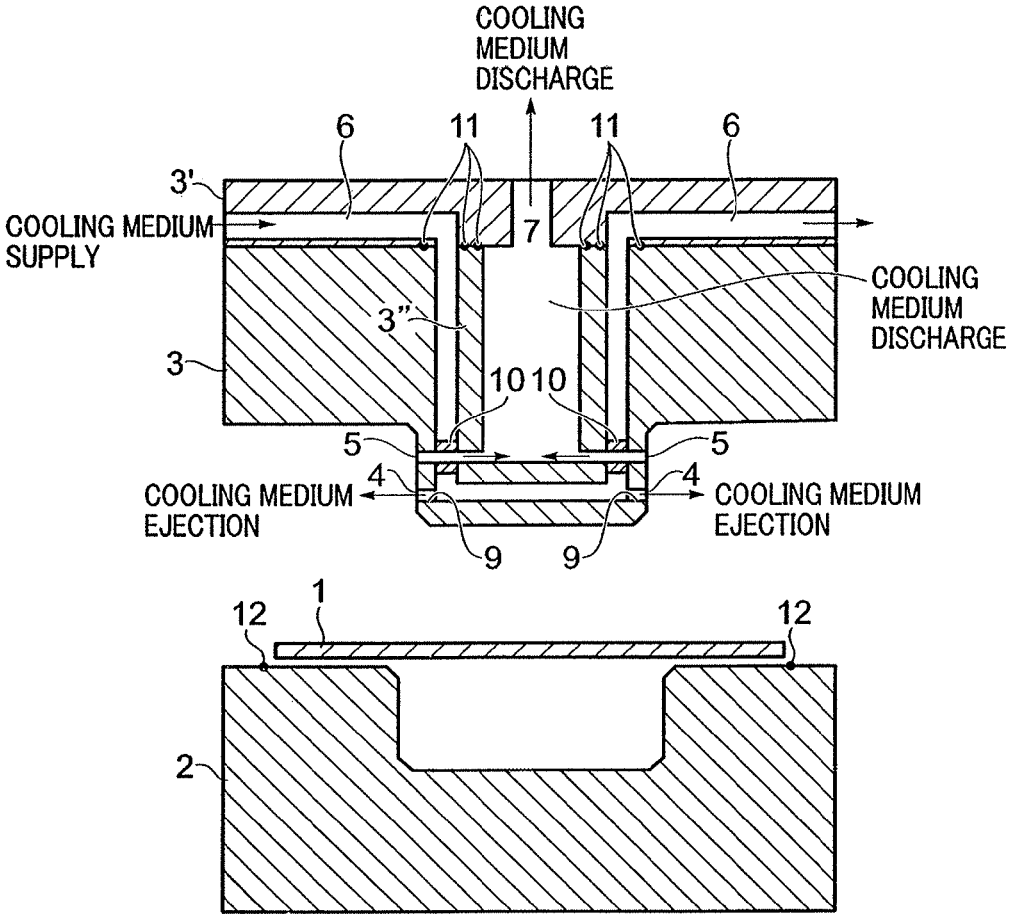
FIG. 2A is a sectional view of an exemplary mold according to another exemplary embodiment of the present invention that is provided with ejection holes, supply piping, discharge holes, and discharge piping for a cooling medium.
Figure 2B:
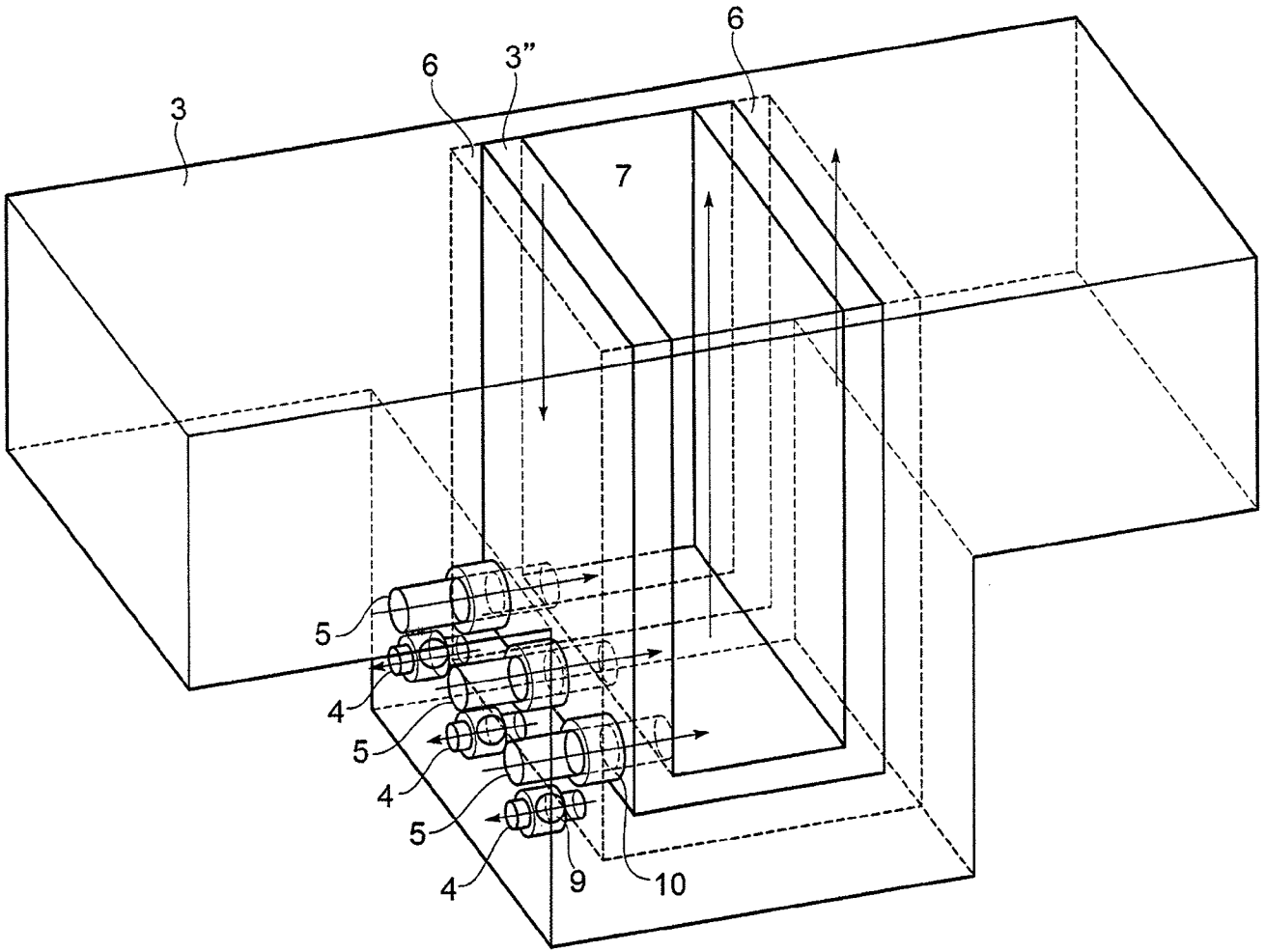
FIG. 2B is a perspective view of the exemplary mold of FIG. 2A.

FIGS. 2A and 2B schematically show side and perspective views of the mold according to another exemplary embodiment of the present invention in which the ejection holes 4 and discharge holes 5 for the cooling medium are provided in a punch 3 that is an upper mold, the supply piping 6 for the cooling medium is provided in a punch holder 3', and discharge piping 7 for the cooling medium is provided in a core 3" and the punch holder 3'. As shown in FIGS. 2A and 2B, the supply piping 6 for the cooling medium can be formed by the core 3" provided inside the punch 3. The discharge piping 7 may be provided in the punch holder 3' and the core 3", and the supply piping 6 for the cooling medium provided in the punch holder 3' and the punch 3 can be respectively connected by bolts via the O-rings 11. As shown in FIGS. 1A and 1B, the rubber O-ring shown as the sealing mechanism 12 for the cooling medium can be provided at the periphery of the lower die 2.

An ejection valve 9 having a spring mechanism can be provided in the ejection hole 4 as shown in FIGS. 2A and 2B, and closes an outlet of the supply piping 6 for the cooling medium, for example, when the punch reaches the bottom dead center at the time of pressing, and when the internal pressure of the cooling medium is increased, the ejection valve 9 can open, and the cooling medium may be ejected from the ejection hole 4 to the surface of the mold. The ejected cooling medium can be discharged from the discharge piping 7 through an intermediate barrel 10 which crosses the supply piping 6 from a discharge hole 5. FIGS. 2A and 2B illustrate that the ejection holes 4 and discharge holes 5 for the cooling medium are provided in a vertical wall portion of the punch, but they may be provided in a bottom portion or may be provided in both the vertical wall portion and the bottom portion.

Figure 3A:
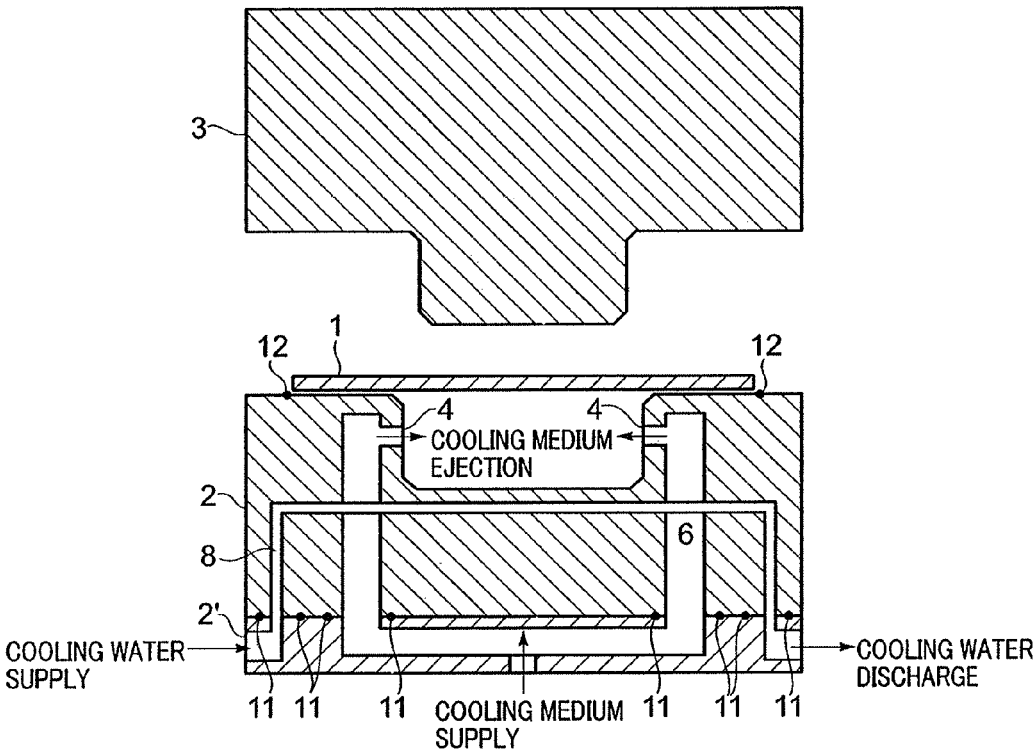
FIG. 3A is a sectional view an exemplary mold according to still another exemplary embodiment of the present invention that is provided with ejection holes, supply piping, and cooling piping for a cooling medium.
Figure 3B:
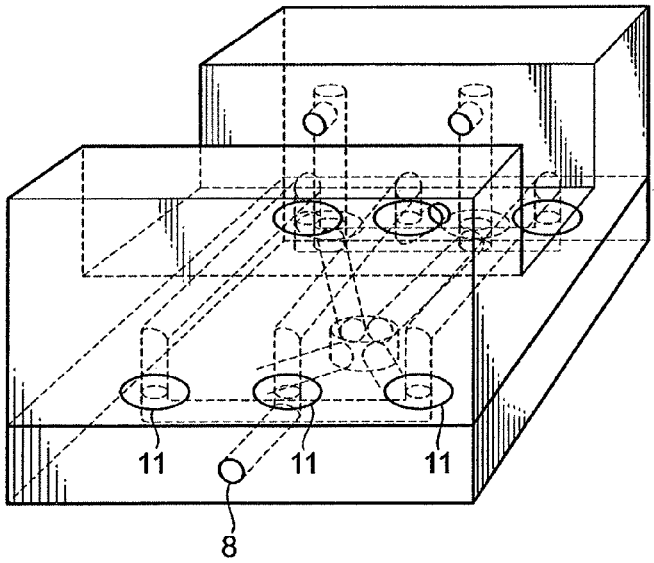
FIG. 3B is a perspective view of the exemplary mold of FIG. 3A.

FIGS. 3A and 3B show side and perspective views of the mold according to still another exemplary embodiment of the present invention in which cooling piping 8 is further provided in the die 2 with the ejection holes 4 and supply piping 6 for the cooing medium shown in FIG. 1. The exemplary mold shown in FIG. 3A can be cooled by the supply piping 6 for the cooling medium. By further providing the cooling piping 8, the cooling of the mold can be accelerated. The cooling piping 8 can also be effective in accelerating the cooling of the mold provided with the supply piping 6 and discharge piping 7 for the cooling medium shown in FIG. 2. Moreover, by providing the cooling piping 8, for example, it is possible to suppress or reduce an increase in the temperature of the mold when press molding is performed until the bottom dead center is reached without the cooling medium being supplied to the supply piping 6.

FIGS. 1A to 3B each show exemplary embodiments of the molds in accordance with the present invention in which the ejection holes 4, supply piping 6, discharge holes 5, discharge piping 7, and cooing piping 8 for the cooling medium are provided in either of the punch 3 and the die 2, but these components/elements may be provided in both of the punch 3 and the die 2. Moreover, it is preferable to provide at least the ejection holes 4 and supply piping 6 for the cooling medium. In such case, it is possible to continuously eject the cooling medium from the ejection holes while continuing to supply the cooling medium to the supply piping 6, and it is also possible to discharge the cooling medium if the supply of the cooling medium to the supply piping 6 is stopped to bring the internal pressure to a negative pressure. Accordingly, depending on the size and shape of the mold, it can be selected appropriately whether the ejection holes 4 and the supply piping 6 are used for discharging the cooling medium or the independent discharge holes 5 and discharge piping 7 are further provided.

When the shapes of the ejection hole 4 and the discharge hole 5 are circular, a sufficient supply of liquid may not be easily obtained due to pressure loss if their diameter is less than about 100 μm. Thus, it can be desirable for the lower limit of the diameter to be about 100 μm or more. On the other hand, if the diameter of the ejection hole 4 and the discharge hole 5 is more than about 10 mm, the shapes thereof can be transferred to the metal plate material. Therefore, it may be desirable for the upper limit of the diameter to be about 10 mm or less. When the shapes of the ejection hole 4 and the discharge hole 5 are rectangular or elliptical and when the ejection hole 4 and the discharge hole 5 have indeterminate forms such as holes of porous metal, the area of a flow path may preferably be approximately equal to that of a circle with a diameter between about 100 μm and 10 mm.

When the pitch of the ejection holes 4 and the discharge holes 5, that is, the distance between the adjacent ejection holes 4 when only the ejection holes 4 are provided or the distance between the adjacent ejection holes 4 or discharge holes 5 when both the ejection holes 4 and the discharge holes 5 are provided is less than 100 μm, the number of holes can increase, resulting in a likely increase in the cost of the exemplary mold. On the other hand, the pitch of the ejection holes 4 and the discharge holes 5 can be more than about 1000 mm, cooling capacity can sometimes become insufficient. Accordingly, it may be desirable that the pitch of the ejection holes 4 and the discharge holes 5 be between about 100 μm and 1000 mm.

For example, it may be desirable that die steel for hot working be used as a material for the mold in terms of hot strength. When the cooling piping is provided in both the punch and the die, die steel for cold working which has a high heat conductivity and which is resistant to heat storage may be used. The ejection holes, discharge holes, and cooling piping can be provided by mechanical drilling by a drill or by drilling by electric discharge machining.

Furthermore, instead of drilling the ejection holes and discharge holes for the cooling medium in the mold, the supply piping for the cooling medium may be connected to porous metal having pores which penetrate from within the mold to the outer surface. In such case, it may be desirable to use porous metal having plural holes with a diameter between about 100 μm and 1 mm, and a pitch between about 100 μm and 10 mm which may penetrate in a thickness direction. For example, if in a punch having a structure such as shown in FIGS. 2A and 2B, die steel is used for the core 3" and porous metal is used for the punch 3, the punch 3 having the fine ejection holes 4 and discharge holes 5 with a small pitch can be manufactured. Such porous metal can be produced by sintering powder after molding or by unidirectional solidification for making the direction of a solidification structure fixed by temperature control after melting metal. It is also possible to manufacture the entire punch 3 or a substantial portion thereof by the porous metal, and/or to provide holes in portions corresponding to the ejection holes 4 and discharge holes 5 for the cooling medium shown in FIGS. 2A and 2B by machining and join the porous metal into the holes by shrink fitting or the like.

Moreover, by providing projections 13 on the molding surface of the mold, the area of contact between the mold and the metal plate material can be reduced, and hence the occurrence of die galling can be suppressed. Furthermore, since the area of contact between the mold, that is, the die 2 or the punch 3 and the metal plate material 1 may be reduce by these projections 13, excessive cooling of the metal plate material 1 due to the movement of heat to the mold during press molding can be suppressed or at least reduced. When the cooling medium is ejected at the bottom dead center, it can become relatively simple to circulate the cooling medium through gaps between the projections 13 and the metal plate material 1, which makes it possible to increase cooling efficiencies of the mold and the metal plate material 1.

Figure 4:
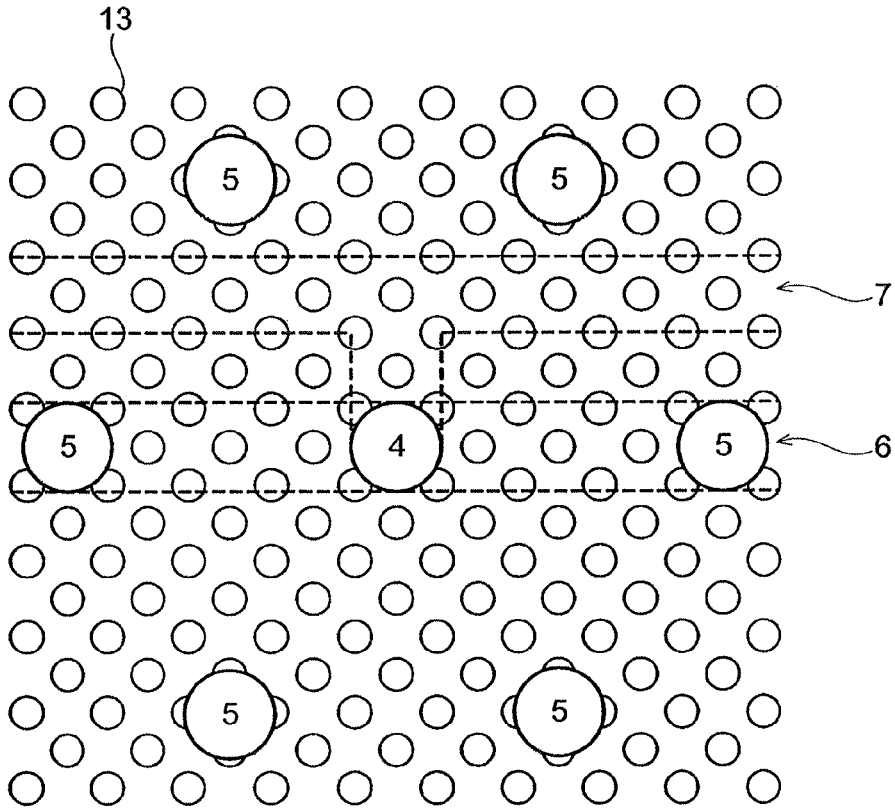
FIG. 4 is a top view of a portion of a surface of an exemplary mold that is provided with ejection holes, discharge holes, and projections in accordance with yet another exemplary embodiment of the present invention.
Figure 5A:
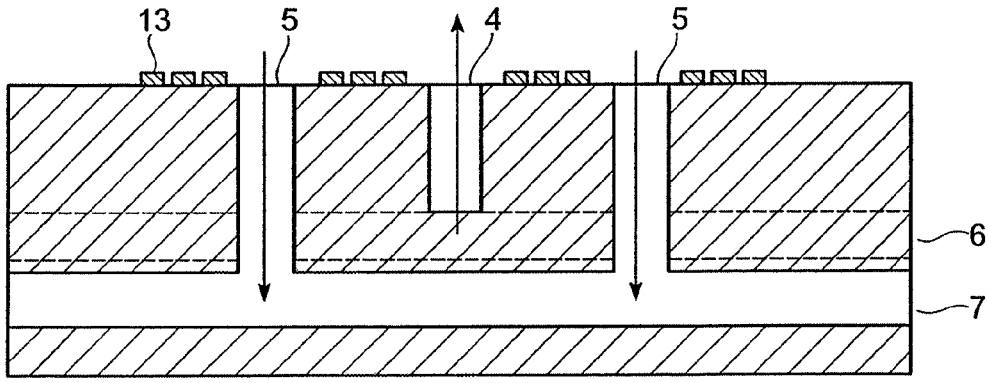
FIG. 5A is a side cut-away view of a part of a section of an exemplary mold according to a further exemplary embodiment of the present invention that is provided with the ejection holes, the discharge holes, and the projections.
Figure 5B:
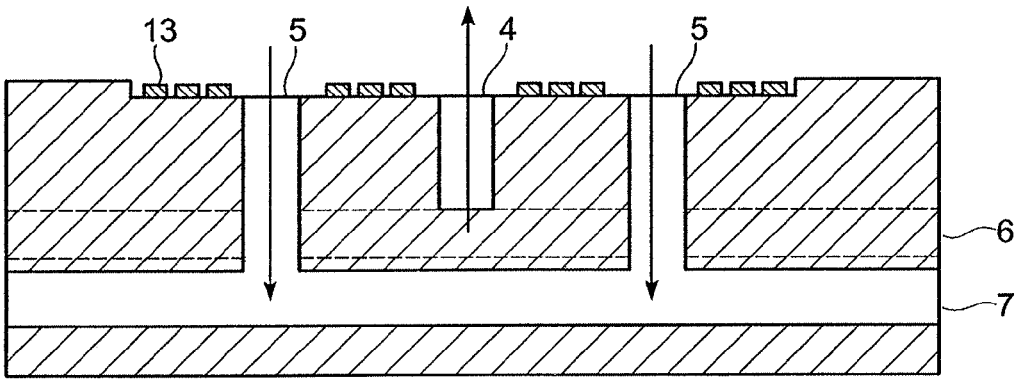
FIG. 5B is a side cut-away view of a part of an exemplary mold according to another exemplary embodiment of the present invention similar the exemplary mold shown in FIG. 5A.

A schematic top view and sectional side views of the surface of part of the mold according to yet another exemplary embodiment of the present invention provided with the projections 13 on its molding surface are shown in FIG. 4 and FIGS. 5A and 5B, respectively. The exemplary projections 13 shown in FIG. 4 and FIGS. 5A and 5B are illustrated as circular cylinders which can be provided at predetermined intervals on the molding surface of the mold, but it is desirable that the shape of their horizontal sections be any of a circular shape, a polygonal shape, and a star-shape, and that the shape of their vertical section be rectangular or trapezoidal. They also may be hemispherical. Incidentally, it may be desirable that plural projections 13 of the mold be provided on the molding surface, and the projections 13 may be provided on part of the molding surface or may be provided on the entire surface. Furthermore, they may be provided on either or both of the punch and the die.

As shown in FIG. 5A, the projections 13 of the mold may be provided on the surface of the molding surface. However, depending on the molding conditions, marks of the projections 13 may sometimes be transferred to the molded piece. To prevent such occurrence, it may be preferable to remove solely peripheries of the projections 13 as shown in FIG. 5B. Furthermore, it is also possible to remove the portions where the projections 13 are provided to a depth equal to the height of the projection 13, and provide the projections 13.

It may be preferred that the height of the projections 13 on the molding surface of the mold be between about 5 μm and 1 mm. This may be because if the height of the projections 13 is lower than about 5 mm, the gap between the mold and the metal plate material 1 is too small, so that it is difficult to circulate liquid between the mold and the metal plate material 1. If the height is higher than 1 mm, the gap may be too large, so that the cooling rate by heat conductivity of the liquid lowers.

It may be preferred that the area ratio of the projections 13 on the molding surface of the mold be between 1% and 90%. This can be because if the area ratio of the projections 13 is less than about 1%, projection shapes on the surface of the mold tend to be transferred to the metal plate material. If the area ratio of the projections 13 is more than about 90%, the gap between the projections is likely narrow, whereby pressure loss becomes larger and the liquid can neither be filled nor flow, which can cause a slight reduction in cooling efficiency.

It may be preferred desirable that the diameter of the projection when the shape of the horizontal section of the projection on the molding surface of the mold is circular or the diameter of a circumcircle of the projection when the shape thereof is polygonal or star-shaped be between 10 μm and 5 mm. This can be because if the diameter of the projection or the diameter of the circumcircle is less than 10 μm, the projection wears badly, and cannot produce an effect over a long period. If the diameter is more than about 5 mm, it would be difficult to perform uniform cooling.

The projections on the molding surface of the mold can be formed by electrochemical machining, chemical etching, electric discharge machining, or a plating method. The exemplary embodiment of the chemical etching procedure according to the present invention can be performed as follows. First, after a visible light curing photosensitive resin is applied on the surface of the mold and dried, visible light can be irradiated to cure an irradiated portion while the surface is covered with a mask for cutting off the visible light. Then, the resin (except on the cured portion) can be removed by an organic solvent. For example, it may be preferable to perform etching by immersing the surface of the mold in an etching solution such as a sodium chloride solution for one minute to thirty minutes. The diameter or pitch of the projections may be selected appropriately depending on the shape of the mask for cutting off the visible light, and the height of the projections may be adjusted appropriately depending on the etching time.

Electro discharge texturing is a processing method in which a copper electrode having recesses each with an inverted shape of the targeted projection as a surface pattern is placed opposite the mold and a pulse direct current is passed, while its current peak value and pulse width are changed. The desirable current value can be between about 2 A and 100 A, and pulse width is between about 2 μsec and 1000 μsec. These values can be adjusted appropriately according to the material of the mold and the desired shape of the projections.

When the plating method is used, in order that the diameter of the hemispherical projection is set to about 10 μm or more, it may be desirable for the thickness of plating to be about 10 μm or more, and that the upper limit thereof to be about 80 μm or less to prevent exfoliation. After alkaline degreasing and electrolytic etching of electrolyzing the mold as an anode in a plating solution, a plating layer can be formed at a predetermined bath temperature and current density. A plating layer with a thickness between about 10 μm and 80 μm can be provided under conditions of a current density approximately between about 1 A/dm$^2$ and 200 A/dm$^2$ and a bath temperature approximately between about 30° C. and 60° C. in a chrome plating solution in the case of chrome plating, and under conditions of a current density approximately between about 1 A/dm$^2$ and 100 A/dm$^2$ and a bath temperature approximately between 30° C. and 60° C. in a NiW plating solution in the case of NiW plating. In order to form a plating layer having a hemispherical projection shape, for example, it is preferable to perform plating at a fixed current density after the current density is increased stepwise.

Furthermore, it may be preferable that the ejection holes 4, the discharge holes 5, and the projections 13 be each provided at a portion where the heat transfer coefficient between the mold and the metal plate material is about 2000 W/m$^2$K or less. For example, by performing hot press molding while measuring the temperatures of the mold and the metal plate material using a thermocouple, a radiation thermometer, or the like before the ejection holes 4, the discharge holes 5, and the projections 13 are each provided, the portion where the heat transfer coefficient between the mold and the metal plate material is about 2000 W/m$^2$K or less can be worked out from the temperature changes of the mold and the metal plate material. It is also possible to calculate the deformation behavior and gap amount between the mold and the metal plate material by FEM and determine the portion where the heat transfer coefficient is 2000 W/m$^2$K or less. Consequently, it becomes possible to eject the cooling medium to a portion which requires acceleration of cooling and enhance cooling, which enables uniform cooling and reductions in the manufacturing cost and cooling cost of the mold.

A hot press molding method according to another exemplary embodiment of the present invention maybe designed to enhance cooling by ejecting the cooling medium to the gap between the mold and the metal plate material during and/or after press molding. For example, when the metal plate material 1 is press-molded using the hot press molding apparatus shown in FIGS. 1A and 1B and FIGS. 3A and 3B, the cooling medium can be supplied from the supply piping 6 and ejected to the gap between the mold and the metal plate material 1 from the ejection holes 4 while the punch 3 is lowered to and held at the bottom dead center. In this case, if the internal pressure in the supply piping 6 is brought to a negative pressure, the cooling medium can be discharged from the ejection holes 4, and hence, if the ejection and discharge of the cooling medium are repeated intermittently, the cooling effect increases. Similarly, as also in the case of the hot press molding apparatus provided with the discharge holes 5 and the discharge piping 7 shown in FIGS. 2A and 2B, the cooling medium can be discharged from the ejection holes 4.

When the nucleate boiling of the cooling medium is predicted using a calculation/determination based on the boiling point of the cooling medium, heat conductivity, the heat capacity of the metal plate material, etc., it may be preferable to constantly eject the cooling medium from the ejection holes to let it flow to the discharge holes. When the nucleate boiling of the cooling medium is not predicted, the gap between the mold and the metal plate material may remain filled with the cooling medium.

The cooling medium may be any of water, a polyhydric alcohol, a polyhydric alcohol solution, polyglycol, a mineral oil with a flash point of 120° C. or higher, synthetic ester, a silicon oil, a fluorine oil, grease with a dropping point of 120° C. or higher, and a water emulsion obtained by mixing a surfactant into a mineral oil or synthetic ester, or a mixture of these may be used in terms of flame retandancy and corrosiveness. Furthermore, the cooling medium may be liquid or vapor.

The hot-press molding method and apparatus according to still another exemplary embodiment of the present invention can also be applicable to any of metal plate materials such as an Al-plated steel plate, a Zn-plated steel plate, ordinary steel, copper, and aluminum. When the material of the metal plate material is steel, it may be preferable that the temperature of the entire steel plate be maintained at not higher than a martensitic transformation point of the steel at the bottom dead center.

EXAMPLES

Certain exemplary embodiments of the present invention will be more specifically below via a use of examples.

A hat-shaped product is manufactured by way of trial by manufacturing the mold which is schematically shown in FIG. 2 by machining, and further drawing Al-plated steel using the hot press molding apparatus provided with the projections 13 which is schematically shown in FIGS. 4 and 5. The length of a specimen is 300 mm, width is 100 mm, thickness is 1.2 mm, and surface roughness is 1.0 μm. The material of the die and the punch is S45C, shoulder width is 5 mm, die width is 70 mm, and die molding depth is 60 mm.

Porous metal is fabricated by unidirectional solidification of fixing a rod with a diameter of 10 mm which is made of stainless steel composed of a SUS304L-based component in a high-pressure container, moving a portion to be heated while partially melting the rod by high-frequency induction heating, and thereby continuously melting and solidifying the rod.

Ejection holes, discharge holes, and projections of the mold are those shown in Table 1, and the surface roughness is 1.0 μm. Incidentally, before processing of providing the ejection holes, the discharge holes, and the projections, hot-press molding is performed while the temperature is measured by a thermocouple to specify portions where the heat transfer coefficient is 2000 $W/m^2K$ or less, and more specifically, the ejection holes, the discharge holes, and the projections are provided in sidewall surfaces of the die and the punch.

The Al-plated steel plate is heated to approximately 950° C. in an atmosphere furnace, and the heated steel plate is set at a molding position between the punch and the die, subjected to hot press molding, held for two seconds at the bottom dead center, and cooled by ejecting the cooling medium. In comparative example 12, it is held for ten seconds at the bottom dead center. Thereafter, the mold is released, and the product is taken out. This molding is performed continuously 100 times. Furthermore, using the specimen and the mold under the same conditions, a comparative product is manufactured by heating the specimen to approximately 950° C., hot press molding it, and then immediately cooling it by immersing it in a tank without holding it.

The hardness, shape, surface damage, and mold surface temperature regarding each of the obtained products are evaluated, and results thereof are shown in Table 1. The hardness of the product is measured at a pitch of 10 mm in a longitudinal direction. If the hardnesses at all positions of all the products are higher than the hardness of the comparative product, the hardness is regarded as good and shown by "◎".

The shape of the product is evaluated by comparing the shape of the product measured by a laser displacement meter with a designed shape, and if the error between the shape of the product and the designed shape is within 10%, the shape is regarded as good and shown by "◎". The evaluation of surface damage is performed by visually examining a sidewall portion of the product, and if no galling is observed in all the products, the evaluation of surface damage is regarded as good and shown by "◎".

If the percent defective of hardness, shape, and surface damage is 1% or less, the comprehensive evaluation is regarded as good and shown by "○", and if it is more than 1%, the comprehensive evaluation is regarded as bad and shown by "x". Furthermore, after molding, the mold surface temperature is measured by a contact-type surface thermometer, and if the mold surface temperature is 80° C. or lower, it is regarded as good and shown by "○", and if it is higher than 80° C., it is regarded as bad and shown by "x".

As shown in Table 1, the products manufactured according to exemplary embodiments of the hot press molding method according to the present invention using the exemplary embodiments of the hot press molding apparatus according to the present invention generally have good hardnesses and shapes, little or no surface damage, may cause a small increase in mold temperature, and can receive good comprehensive evaluations. On the other hand, in comparative examples 11 and 12 shown in Table 1, a conventional molding apparatus provided with no ejection hole for the cooling medium is used, and the comparative example 12 which has a longer holding time than the comparative example 11 has good hardness and shape, but may receive less than positive comprehensive evaluation.

TABLE 1

| | | HOLECONFIGURATION | | | | | | | PROJECTION | | | |
|---|---|---|---|---|---|---|---|---|---|---|---|---|
| | | EJECTION HOLE | DIS-CHARGE HOLE | POROUS METAL | DIAM-ETER (mm) | PITCH (mm) | COOL-ING PIPING | SEAL STRUC-TURE | SHAPE | CIRCUM-CIRCLE DIAMETER (μm) | HEIGHT (μm) | AREA RATIO (%) |
| PRESENT INVEN- | 1 | ○ | — | — | 0.1 | 0.1 | NONE | — | — | | | |
| | 2 | ○ | ○ | — | 1 | 5 | NONE | — | HEMI- | 10 | 5 | 1 |

TABLE 1-continued

| | | | | | | | | | | | | |
|---|---|---|---|---|---|---|---|---|---|---|---|---|
| TION | 3 | ○ | ○ | — | 2 | 10 | NONE | — | SPHERE HEMI-SPHERE | 50 | 25 | 30 |
| | 4 | ○ | ○ | — | 5 | 20 | EXIST | — | FRUSTUM OF CONE | 300 | 100 | 20 |
| | 5 | ○ | ○ | — | 10 | 300 | EXIST | — | CYLINDER | 500 | 200 | 30 |
| | 6 | ○ | ○ | — | 3 | 50 | EXIST | RUBBER O-RING SEAL | FRUSTUM OF SIX-SIDED PYRAMID | 1000 | 300 | 60 |
| | 7 | ○ | ○ | — | 5 | 500 | EXIST | RUBBER O-RING SEAL | HEXAG-ONAL CYLINDER | 2000 | 1000 | 70 |
| | 8 | ○ | ○ | — | 6 | 1000 | EXIST | RUBBER O-RING SEAL | FRUSTUM OF QUAD-RAN-GULAR PYRAMID | 5000 | 500 | 90 |
| | 9 | — | — | ○ | 0.1 | 0.2 | NONE | — | — | — | — | — |
| | 10 | — | — | ○ | 0.5 | 1 | NONE | — | — | — | — | — |
| COMPAR-ATIVE EXAMPLE | 11 | | | | | | NONE | | | | | |
| | 12 | | | | | | NONE | | | | | |

| | | PLATING | | PROJECTION | EVALUATION | | | | |
|---|---|---|---|---|---|---|---|---|---|
| | | TYPE | THICKNESS (μm) | MANUFACTURING METHOD | HARDNESS | SHAPE | SURFACE DAMAGE | COMPREHENSIVE EVALUATION | MOLD TEMPERATURE |
| PRESENT INVEN-TION | 1 | — | | | ○ | ○ | ○ | ○ | ○ |
| | 2 | Cr | 30 | PLATING | ◎ | ◎ | ◎ | ◎ | ○ |
| | 3 | NiW | 50 | PLATING | ◎ | ◎ | ◎ | ◎ | ○ |
| | 4 | — | — | LITHOGRAPHY | ◎ | ◎ | ◎ | ◎ | ○ |
| | 5 | — | — | LITHOGRAPHY | ◎ | ◎ | ◎ | ◎ | ○ |
| | 6 | — | — | ELECTRIC DISCHARGE MACHINING | ○ | ○ | ◎ | ○ | ○ |
| | 7 | — | — | ELECTRIC DISCHARGE MACHINING | ○ | ○ | ◎ | ○ | ○ |
| | 8 | — | — | SHOT BLASTING | ○ | ○ | ◎ | ○ | ○ |
| | 9 | — | — | — | ○ | ○ | ○ | ○ | ○ |
| | 10 | — | — | — | ○ | ○ | ○ | ○ | ○ |
| COMPAR-ATIVE EXAMPLE | 11 | | NONE | | X | X | X | X | X |
| | 12 | | NONE | | ○ | ○ | X | X | X |

EXEMPLARY INDUSTRIAL APPLICABILITY

Exemplary embodiments of the present invention provide that when a pressed product excellent in strength and dimensional accuracy is manufactured using a high-strength metal plate material with low press moldability as a material by hot press molding, it is possible to increase productivity and further suppress heat storage into a mold to lengthen the life of the mold, thereby reducing a manufacturing cost.

What is claimed is:

1. An apparatus for press molding a heated metal plate material, comprising:

a supply piping arrangement provided in a mold and configured to interact with a cooling medium;

ejection holes provided in a molding surface of the mold and configured to interact with the cooling medium, the supply piping arrangement and the ejection holes communicating with one another; and a valve mechanism provided in at least one of the ejection holes, wherein the ejections holes are configured to open and eject the cooling medium to the molding surface of the mold when the mold substantially reaches a bottom center of the apparatus.

2. The apparatus according to claim 1, wherein at least one of the ejection holes is provided solely in a portion of the molding surface of the mold where a heat transfer coefficient between the metal plate material and the mold is at most about 2000 $W/m^2K$.

3. The apparatus according to claim 1, further comprising:

a discharge piping arrangement provided in the mold and configured to interact with the cooling medium; and discharge holes provided in the molding surface of the mold and configured to interact with the cooling medium, wherein the discharge piping arrangement and the discharge holes communicate with one another.

4. The apparatus according to claim 1, further comprising a cooling piping arrangement provided in the mold.

* * * * *